US008994285B2

(12) United States Patent
Storm

(10) Patent No.: US 8,994,285 B2
(45) Date of Patent: Mar. 31, 2015

(54) ELECTRONIC BALLAST AND METHOD FOR OPERATING AT LEAST ONE DISCHARGE LAMP

(75) Inventor: Arwed Storm, Dachau (DE)

(73) Assignee: Osram AG, Munich (DE)

( * ) Notice: Subject to any disclaimer, the term of this patent is extended or adjusted under 35 U.S.C. 154(b) by 134 days.

(21) Appl. No.: 13/498,150

(22) PCT Filed: Aug. 12, 2010

(86) PCT No.: PCT/EP2010/061769

§ 371 (c)(1),
(2), (4) Date: Mar. 26, 2012

(87) PCT Pub. No.: WO2011/038974

PCT Pub. Date: Apr. 7, 2011

(65) Prior Publication Data

US 2012/0181945 A1 Jul. 19, 2012

(30) Foreign Application Priority Data

Sep. 29, 2009 (DE) ..... 10 2009 043 611

(51) Int. Cl.
*H05B 37/02* (2006.01)
*H05B 41/282* (2006.01)

(52) U.S. Cl.
CPC ..... *H05B 41/2828* (2013.01)
USPC ..... 315/224; 315/307

(58) Field of Classification Search
USPC ..... 315/210, 209 R, 224–226, 291, 294, 315/297, 307
See application file for complete search history.

(56) References Cited

U.S. PATENT DOCUMENTS 5,604,411 A * 2/1997 Venkitasubrahmanian et al. ..... 315/307
5,925,990 A * 7/1999 Crouse et al. ..... 315/307
(Continued)

FOREIGN PATENT DOCUMENTS

CN 1179077 A 4/1998
CN 1550066 A 11/2004
(Continued)

OTHER PUBLICATIONS

Chinese Office Action of corresponding application No. 201080043652.3, mailed Nov. 14, 2013.

*Primary Examiner* — Tung X Le

(57) ABSTRACT

In various embodiments, ballast for a discharge lamp includes input and output connections; inverter with bridge circuit with electronic switches and control device for controlling electronic switches, wherein switches are connected in series between input connections, wherein one electronic switch is coupled to first input connection and second electronic switch to second input connection, wherein a bridge midpoint is between electronic switches; including a current measuring device for measuring second electronic switch current; lamp choke series-connected between bridge midpoint and first output connection; capacitor parallel-connected with one of electronic switches; and coupling capacitor; wherein control device is coupled to current measuring device and renders an electronic switch conducting, if negative threshold value is exceeded when electronic switch is rendered nonconducting; or if negative threshold value of current through electronic switch is not exceeded after another electronic switch is rendered nonconducting, wherein control device increases first frequency in second case.

11 Claims, 3 Drawing Sheets

(56) References Cited

U.S. PATENT DOCUMENTS

Figure 4:
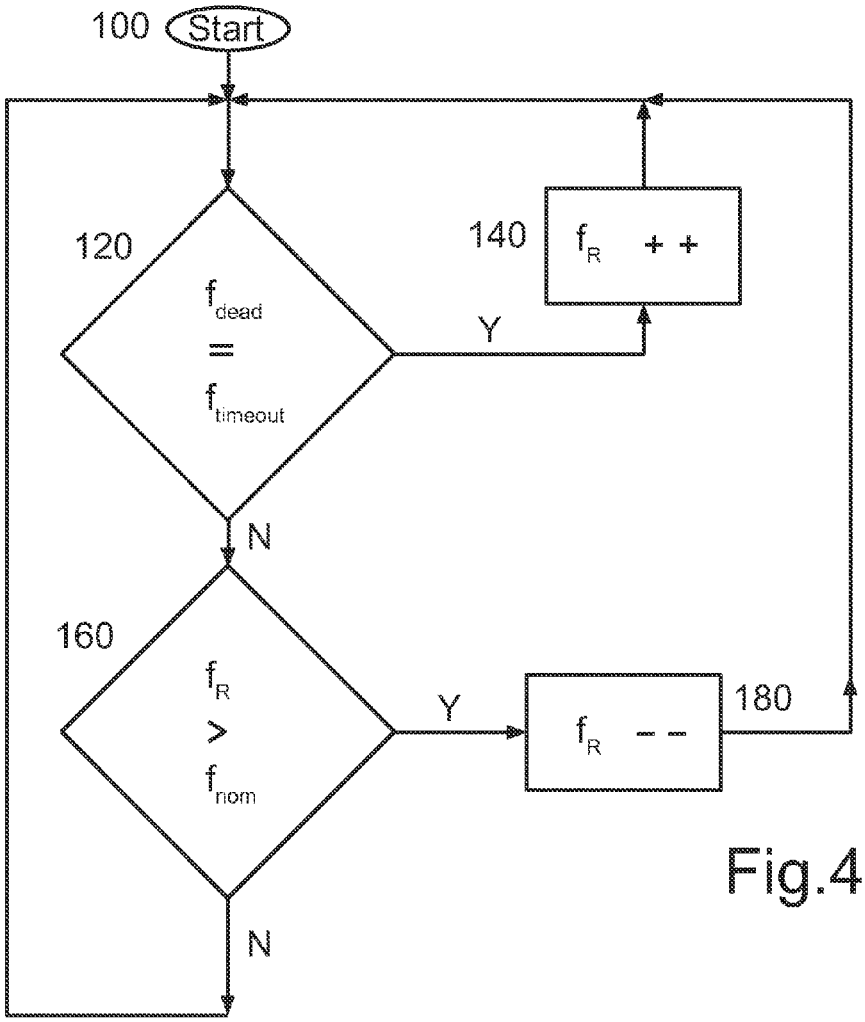

| | | | | |
|---|---|---|---|---|
| 6,466,456 | B2 * | 10/2002 | Sauerlaender et al. | 363/16 |
| 6,548,963 | B2 * | 4/2003 | Van Casteren et al. | 315/209 R |
| 6,605,976 | B2 | 8/2003 | Middel et al. | |
| 7,564,200 | B2 * | 7/2009 | Ichikawa et al. | 315/308 |
| 7,745,970 | B2 * | 6/2010 | Radecker et al. | 310/316.01 |
| 2008/0150442 | A1 | 6/2008 | Feldtkeller | |

FOREIGN PATENT DOCUMENTS

| | | | |
|---|---|---|---|
| DE | 102006061357 | A1 | 6/2008 |
| WO | 2009037613 | A1 | 3/2009 |

* cited by examiner

ELECTRONIC BALLAST AND METHOD FOR OPERATING AT LEAST ONE DISCHARGE LAMP

RELATED APPLICATIONS

The present application is a national stage entry according to 35 U.S.C. §371 of PCT application No.: PCT/EP2010/061769 filed on Aug. 12, 2010, which claims priority from German Application No.: 10 2009 043 611.1, filed on Sep. 29, 2009.

TECHNICAL FIELD

Various embodiments relate to an electronic ballast for operating at least one discharge lamp, including an input having a first and a second input connection for coupling to a DC supply voltage, an output having a first and a second output connection for coupling to the at least one discharge lamp, an inverter having a bridge circuit with at least one first and one second electronic switch and a control device for controlling at least the first and the second electronic switch such that the first and the second electronic switch are alternately rendered conducting at a first frequency, wherein the first and the second switch are connected in series between the first and the second input connection, wherein the first electronic switch is coupled to the first input connection and the second electronic switch is coupled to the second input connection, wherein a first bridge midpoint is implemented between the first and the second electronic switch, a current measuring device for measuring the current at least through the second electronic switch, a lamp choke which is connected in series between the first bridge midpoint and the first output connection, at least one trapezoidal capacitor which is connected in parallel with one of the two electronic switches and at least one coupling capacitor for coupling the load, wherein the control device is coupled to the current measuring device and is designed to render the second electronic switch conducting, either if a predefinable negative threshold value of the current through the second electronic switch is exceeded after the first electronic switch has been rendered nonconducting or after a predefinable time if the predefinable negative threshold value of the current through the second electronic switch is not exceeded after the first electronic switch has been rendered nonconducting. It also relates to a corresponding method for operating a discharge lamp.

BACKGROUND

Known as multi-lamp EBs, electronic ballasts designed to operate different lamps, particularly lamps of different wattages, have been commercially available for some time. One problem in this context is that of ensuring soft switching of the inverter bridge circuit in the case of different loads.

In the following description it will be assumed that the inverter is equipped with a half bridge. As will be immediately obvious to the person skilled in the art, the following description is equally applicable to inverters with switches in a full-bridge configuration.

In a prior art Infineon controller for discharge lamps, switching during the conducting phase of the freewheeling diode via the second electronic switch is ensured as follows: the current in the lower branch of the bridge is measured using a half bridge shunt resistor. The undershooting of a negative threshold of the current is equated with the point in time at which the freewheeling diode of the lower switching element becomes conducting. This event triggers the closure of the lower half bridge switch and therefore determines the dead time of the control signals for the switches of the half bridge.

This form of control is problematic when the bridge circuit is operated at a frequency immediately above the phase shift, i.e. above the transition from inductive operation to capacitive operation at high loads. In this operating mode, the available current for recharging the trapezoidal capacitor may be very small. This poses the risk that the negative threshold of the current through the half bridge shunt resistor will not be reached. In this case the dead time control known from the prior art adjusts the maximum dead time, i.e. a maximum specifiable time duration. As a result, the switching operation of the lower half bridge switch is executed after the flow of current through the freewheeling diode has already been terminated. Since at this point in time the voltage across the lower half bridge switch is non-zero, the lower switch of the half bridge no longer operates in a soft-switched manner. This results in undesirable switching losses and overloading of the transistors involved. The latter results, among other things, in a reduction in the service life of electronic ballasts of this kind.

In order nevertheless to ensure reliable soft switching of the half bridge, the resonant circuit normally present can be designed with large resonant capacitances. However, this measure results in increased reactive currents and therefore undesirably large losses in the inverter.

SUMMARY

Various embodiments develop a generic electronic ballast and a generic method such that soft switching with minimal losses can be provided at different connected loads even when the electronic ballast is operated close to the phase shift.

Various embodiments are-based on the insight that the above problem can be solved if, when determining a switching operation after the maximum dead time has been attained, the frequency at which the switches of the half bridge are operated is increased. Increasing this frequency causes the operating frequency to be shifted from a transition frequency between capacitive and inductive operation in the direction of inductive operation. This results in a larger negative current amplitude when the current is transferred through the freewheeling diode of the lower switch. If the operating frequency of the two switches is increased to the extent that the predefinable negative threshold value of the current through the lower switch is again exceeded, the known dead time control will operate again; soft operation of the inverter switches can be ensured.

This solution works without increasing the capacitance of the resonant capacitor and therefore involves no additional losses.

Each of the two electronic switches includes a control electrode, a working electrode and a reference electrode. It can now be provided that a discrete diode is connected as a freewheeling diode in parallel with the working electrode—reference electrode section or that the freewheeling diode constitutes a body diode of the electronic switch. The latter is the case, for example, if MOSFETs are used as switches.

The control device of an electronic ballast according to various embodiments preferably contains a memory in which the predefinable time is stored. In particular, this opens up the possibility of modifying this time on a lamp-specific basis as required.

It is also preferable for the control device to incorporate a time measuring device in order to determine the time from the first electronic switch being rendered nonconducting to the second electronic switch being rendered conducting.

The control device is preferably designed to execute the following step: c1) If the time measured is equal to the predefinable time: increase the first frequency by a predefinable increment. In this context the control device is preferably also designed to execute the following step: c2) Repeat c1) in any case until the time measured is less than the predefinable time. Altogether this causes the operating frequency of the switches of the half bridge to be increased in predefinable stages until the dead time no longer corresponds to the maximum dead time. As overly increasing the operating frequency of the switches of the half bridge would reduce the power transferable to the lamp, this procedure constitutes an optimum compromise between soft operation of the switches of the half bridge and transferring maximum power to the connected lamp.

The control device is also preferably designed to execute the following step: d1) If the measured time is less than the predefinable time: reduce the first frequency by a predefinable increment. In this regard the control device is preferably also designed to execute the following step: d2) Repeat step d1) until a predefinable value for the first frequency is reached. These measures in particular allow for the situation when initially a discharge lamp of higher power or rather higher lamp voltage is connected to the output of the electronic ballast, said lamp voltage reducing again during operation as a result of temperature effects. If the operating frequency for the half bridge switches which has occurred during operation of the higher power lamp were to be maintained, less power than actually possible would be transferred to the lower voltage lamp. By progressively reducing the operating frequency of the switches of the half bridge it can be ensured that, on the one hand, the switches are operated in a soft manner and that, on the other hand, maximum power is transmitted to the discharge lamp connected to the output of the electronic ballast. In this context, algorithms for selecting the increment size can be implemented which only very rarely cause the half bridge switches to operate in a non-soft manner, e.g. every 100th or 1000th switching operation. Such infrequent non-soft switching only results in insignificant losses, but allows optimized operation of the electronic ballast in respect of power transfer.

Further advantageous embodiments will emerge from the sub-claims.

The various embodiments and their advantages set forth in respect of the electronic ballast according to the various embodiments equally apply where applicable to the method according to various embodiments.

BRIEF DESCRIPTION OF THE DRAWING(S)

Figure 1:
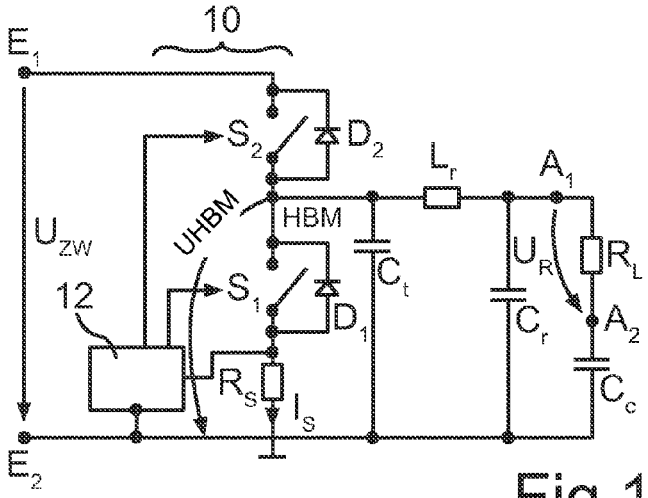
Figure 2:
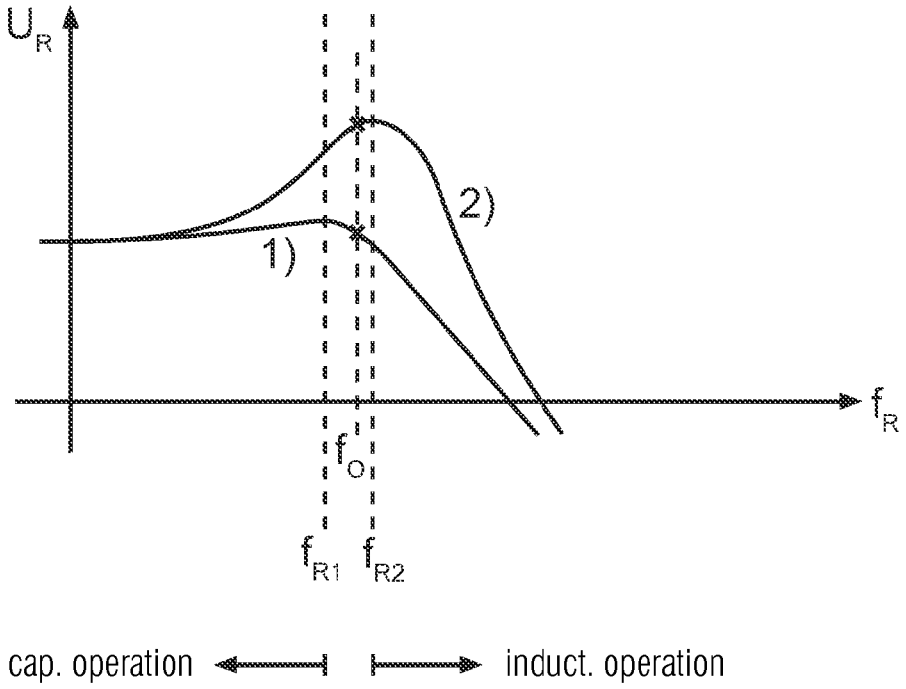
Figure 3:
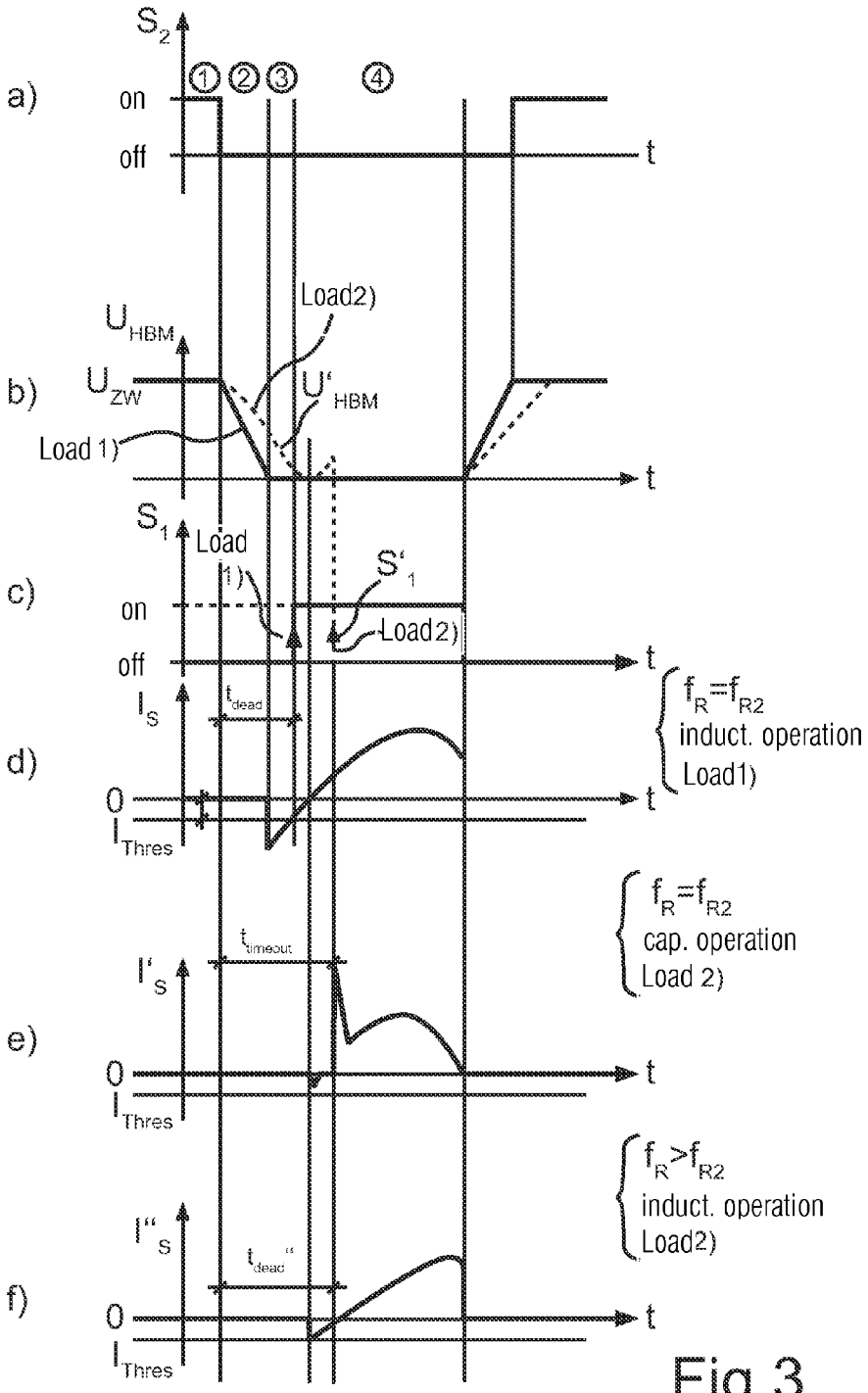

In the drawings, like reference characters generally refer to the same parts throughout different views. The drawings are not necessarily to scale, emphasis instead being generally upon illustrating the principles of the invention. In the following description, various embodiments are described with reference to the following drawings, in which:

FIG. 1 schematically illustrates an exemplary embodiment of an electronic ballast according to the invention;

FIG. 2 schematically represents the output voltage as a function of the operating frequency of the inverter switches for two different loads;

FIG. 3 shows the waveforms of various electrical quantities for the exemplary embodiment from FIG. 1; and FIG. 4 schematically illustrates a signal flow graph of an exemplary embodiment of a dead time control system according to the invention.

DETAILED DESCRIPTION

The following detailed description refers to the accompanying drawings that show, by way of illustration, specific details and embodiments in which the invention may be practiced.

FIG. 1 schematically illustrates an exemplary embodiment of an electronic ballast according to various embodiments. Although various embodiments will now be described using the example of an inverter including a half bridge circuit, it will be clear to the person skilled in the art that the inventive principles are also applicable to a full bridge inverter.

The electronic ballast shown in FIG. 1 has an input with a first E1 and second input connection E2 for coupling to a DC supply voltage. In this case, this is the so-called DC link voltage $U_{Zw}$ which is usually derived from an AC line voltage. Said DC link voltage $U_{Zw}$ is applied to an inverter 10 including a first S1 and a second electronic switch S2 in a half bridge arrangement. To control the switches S1, S2, a control device 12 is provided. The control device 12 controls the switches S1, S2 in particular such that the first and the second switch S1, S2 are alternately rendered conducting at a first frequency. For this purpose, the control device 12 is coupled to a current measuring device which in this case includes a shunt resistor $R_S$ arranged in series with the first switch S1. The current flowing through the shunt resistor $R_S$ is denoted $I_S$. The switches S1, S2 are implemented as MOSFETs, the respective body diode D1, D2, which here acts as a freewheeling diode in each case, being marked to simplify the following description.

A first half bridge midpoint HBM is implemented between the switches S1, S2, the voltage dropped across the half bridge midpoint being denoted $U_{HBM}$. A trapezoidal capacitor $C_t$ is connected in parallel with the lower half bridge branch. A lamp choke $L_R$ is connected between the first half bridge midpoint HBM and a first output connection A1 of the electronic ballast. Between the first output connection A1 and a second output connection A2, which here constitutes a second half bridge midpoint, an output voltage $U_R$ is supplied to a load $R_L$ which in this case includes at least one discharge lamp. A coupling capacitor $C_C$ is connected between the second output connection A2 and the reference potential, represented by the connection E2. A resonant capacitor $C_R$ is connected in parallel with the series circuit of the load $R_L$ and the coupling capacitor $C_C$.

FIG. 2 schematically illustrates the voltage $U_R$ provided between the output connections A1, A2 plotted against the operating frequency $f_R$ with which the control device 12 controls the switches S1, S2 for two different loads $R_L$. Curve family 1) represents a low-resistance load 1) (low lamp voltage, low output power) with a resonant frequency $f_{R1}$, curve family 2) a higher-resistance load 2) with a resonant frequency $f_{R2}$. As can be clearly seen, the frequency $f_{R2}$ is greater than the frequency $f_{R1}$. During operation at the frequency $f_0$, the resonant circuit would be operated inductively with the first mentioned load (curve family 1)) and capacitively with the second mentioned load (curve family 2)).

FIG. 3 shows the waveforms of different electrical quantities for the exemplary embodiment from FIG. 1. It shows in particular the waveform of the ON and OFF state of the switch S2 (curve family a)), of the voltage $U_{HBM}$ (curve family b)) and of the ON and OFF state of the switch S1 (curve family c)). Additionally shown is the waveform of the current $I_S$, namely initially for inductive operation ($f_R$=$f_{R2}$) at load 1) (curve family d)), for capacitive operation in the phase shift at load 2) ($f_R$=$f_{R2}$) (curve family e)), and for the same load as curve family e) but now during operation at a frequency $f_R$ greater than $f_{R2}$ (curve family f)).

The respective waveforms are subdivided into four different phases. In phase 1, the switch S2 is ON (closed), i.e. conducting. As a result, the potential at the half bridge midpoint is at the potential of the DC link voltage $U_{Zw}$. The switch S1 is OFF (open) during this time. The current through the shunt resistor $R_S$ is likewise zero. Consequently, in phase 1 the current flows via the switch S2 and the choke $L_R$ to the load $R_L$.

The transition to phase 2 is characterized in that the switch S2 goes to the OFF state, while the switch S1, however, is not yet turned on (closed). The current that continues to be driven by the choke $L_R$ consequently flows out of the trapezoidal capacitor $C_T$ through the choke $L_R$ to the load $R_L$. The potential at the half bridge midpoint is reduced linearly to zero. The start of phase 2 corresponds to the start of the dead time $t_{dead}$.

The transition from phase 2 to phase 3 is characterized in that the trapezoidal capacitor is discharged. The freewheeling diode D1 becomes conducting and clamps the voltage at the half bridge midpoint to approximately −0.7 V. The current now flows via the freewheeling diode D1 and the choke $L_R$ to the load $R_L$. With respect to curve family d), a negative current $I_S$ consequently flows from the time at which the freewheeling diode D1 has become conducting. If this current reaches a threshold $I_{Thres}$, this is used as per the prior art to initiate the turn-on process (closing operation) of the switch S1. The turn-on process of the switch S1 represents the start of phase 4. The time between the start of phase 2 and the end of phase 3 constitutes the dead time $t_{dead}$. Phase 3 denotes the time interval within which the switch S1 can be soft-switched. The voltage $U_{HBM}$ dropped across the switch S1 is equal to zero within this period.

In phase 4, the current now begins to flow through the switch S1, which means that the flow of current in phase 4, see curve family d), is approximately sinusoidal until switch S1 is turned off (opened).

The apostrophized waveforms occur when the load $R_L$ is increased, i.e. with respect to FIG. 2 at load 2). Consequently, after a turn-off operation of the switch S2 the potential at the half bridge midpoint reduces much more slowly, see $U'_{HBM}$ in curve family b). However, at the point in time when the voltage $U'_{HBM}$ attains ground potential, the negative peak of the current $I'_S$, see curve family e), is not negative enough to attain the threshold value $I_{Thres}$. As a result, a switching operation of switch S1, see curve S1' in curve family c), is not initiated until the maximum predefinable time $t_{timeout}$ has been reached.

When the switch S1 is turned on, see curve S1', a needle-shaped current $I'_S$ now appears, caused by the discharging of the trapezoidal capacitor $C_t$. Since at this instant $U'_{HBM}$ is no longer zero, the switch S1 is not soft-switched.

Whereas curve family d) and e), as mentioned, were plotted at a first operating frequency $f_R=f_{R2}$ for the switches of the half bridge, a second operating frequency $f_R>f_{R2}$ is now selected for curve family f). The increase in the frequency $f_R$ causes the negative current pulse to rise at the instant at which the potential at the half bridge midpoint goes to zero, compare curve family f) with curve family e). The threshold $I_{Thres}$ is again reached, allowing soft turn-on of the switch S1.

FIG. 4 schematically illustrates a signal flow graph for controlling the dead time $t_{dead}$. The method begins in step 100. In step 120 it is checked whether the dead time $t_{dead}$ measured using the timer is equal to the predefinable time $t_{timeout}$.

If this is the case, in step 140 the frequency $f_R$ at which the switches of the half bridge are operated is increased. Step 120 is then repeated. As a result of the measure in step 140, the resonant frequency is again shifted further into the inductive region, see FIG. 2. This results in a larger negative current amplitude at takeover by the freewheeling diode, causing the dead time control to operate again.

However, if it is established in step 120 that the dead time $t_{dead}$ is less than the predefined time $t_{timeout}$, it is checked in step 160 whether the current operating frequency $f_R$ is greater than a nominal operating frequency $f_{nom}$. The nominal operating frequency $f_{nom}$ represents a minimum operating frequency of the electronic ballast. If it is found that the operating frequency $f_R$ is above the nominal operating frequency $f_{nom}$, in step 180 the operating frequency $f_R$ is reduced, leading back to Start.

However, if it is established in step 160 that the nominal operating frequency $f_{nom}$ has been reached, this leads back to Start without the current operating frequency $f_R$ being changed.

The execution of steps 160, 180 is particularly important if a lamp was initially operated at a higher lamp voltage across the electronic ballast, which has then fallen due to thermal effects, for example. Without adjustment to the nominal operating frequency $f_{nom}$, the lamp would in this case be operated permanently at elevated frequency and therefore at reduced power. Thus the control relationship shown in FIG. 4 on the one hand enables the dead time control to operate and, on the other, allows each lamp connected to the electronic ballast to operate at the optimum operating frequency.

The respective reaching of the predefinable time $t_{timeout}$ can be particularly easily detected digitally. Depending on implementation, the half bridge frequency can be increased digitally, e.g. by digital PWM registers for the turn-on times of the switching elements, or in an analog manner by an offset at the input of a VCO or CCO.

However, the sequence shown in FIG. 4 must be activated only when the lamp is lit and not during preheating or ignition of the discharge lamp, in order to prevent unwanted interactions with other protection and control mechanisms.

As will be obvious to the person skilled in the art, the trapezoidal capacitor $C_t$ and the coupling capacitor $C_C$ can also be disposed elsewhere. Moreover, a plurality of trapezoidal capacitors and coupling capacitors can also be provided, as will again be obvious to the person skilled in the art.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An electronic ballast for operating at least one discharge lamp, comprising an input having a first and a second input connection for coupling to a DC supply voltage;

an output having a first and a second output connection for coupling to the at least one discharge lamp;

an inverter having a bridge circuit with at least one first and one second electronic switch and a control device for controlling at least the first and the second electronic switch such that the first and the second electronic switch are alternately rendered conducting at a first frequency, wherein the first and the second switch are connected in series between the first and the second input connection, wherein the first electronic switch is coupled to the first input connection and the second electronic switch to the second input connection, wherein a first bridge midpoint is implemented between the first electronic switch and the second electronic switch;

a current measuring device for measuring the current at least through the second electronic switch;

a lamp choke which is connected in series between the first bridge midpoint and the first output connection;

at least one trapezoidal capacitor which is connected in parallel with one of the two electronic switches; and at least one coupling capacitor for coupling the load;

wherein the control device is coupled to the current measuring device and is designed to render the second electronic switch conducting a) if a predefinable negative threshold value of the current through the second electronic switch is exceeded when the first electronic switch is rendered nonconducting or b) if the predefinable negative threshold value of the current through the second electronic switch is not exceeded after the first electronic switch has been rendered nonconducting after a predefinable time;

wherein the control device is configured to increase the first frequency in case b).

2. The electronic ballast as claimed in claim 1, configured so that each of the two electronic switches comprises a control electrode, a working electrode and a reference electrode, wherein a freewheeling diode is connected in parallel with the working electrode—reference electrode section.

3. The electronic ballast as claimed in claim 2, configured so that the freewheeling diode constitutes a body diode of the electronic switch.

4. The electronic ballast as claimed in claim 2, configured so that the freewheeling diode constitutes a discrete component.

5. The electronic ballast as claimed in claim 1, configured so that the control device comprises a memory in which the predefinable time is stored.

6. The electronic ballast as claimed in claim 1, configured so that the control device comprises a timer which is designed to measure a time from the first electronic switch being rendered nonconducting to the second electronic switch being rendered conducting.

7. The electronic ballast as claimed in claim 6, configured so that the control device is designed to execute the following step:

c1) if the measured time is equal to the predefinable time: Increase the first frequency by a predefinable increment.

8. The electronic ballast as claimed in claim 7, configured so that the control device is additionally designed to execute the following step:

c2) Repeat step c1) in any case until the measured time is less than the predefinable time.

9. The electronic ballast as claimed in claim 7, configured so that the control device is also designed to execute the following step:

d1) if the measured time is less than the predefinable time: Reduce the first frequency by a predefinable increment.

10. The electronic ballast as claimed in claim 9, configured so that the control device is additionally designed to execute the following step:

d2) Repeat step d1) until a predefinable value for the first frequency is reached.

11. A method for operating a discharge lamp from an electronic ballast comprising an input having a first and a second input connection for coupling to a DC supply voltage; an output having a first and a second output connection for coupling to the at least one discharge lamp; an inverter having a bridge circuit with at least one first and one second electronic switch and a control device for controlling at least the first and the second electronic switch such that the first and the second electronic switch are alternately rendered conducting at a first frequency, wherein the first and the second switch are connected in series between the first and the second input connection, wherein the first electronic switch is coupled to the first input connection and the second electronic switch to the second input connection, wherein a first bridge midpoint is implemented between the first and the second electronic switch; a current measuring device for measuring the current at least through the second electronic switch; a lamp choke connected in series between the first bridge midpoint and the first output connection; at least one trapezoidal capacitor connected in parallel with one of the two electronic switches;

and at least one coupling capacitor for coupling the load; wherein the control device is coupled to the current measuring device and is designed to render the second electronic switch conducting a) if a predefinable negative threshold value of the current through the second electronic switch is exceeded after the first electronic switch is rendered nonconducting or b) if the predefinable negative threshold value of the current through the second electronic switch not exceeded after the first electronic switch is rendered nonconducting after a predefinable time, wherein the first frequency is increased in case b).

* * * * *